US006053164A

United States Patent [19]

Oslin et al.

[11] Patent Number: 6,053,164

[45] Date of Patent: Apr. 25, 2000

[54] COOKING WORK STATION WITH SPLASH GUARD

[75] Inventors: G. Robert Oslin, Chicago; Adison Khnanisho, Morton Grove; Chester F. Robards, Jr., Roselle; Roger A. Gladu, Glendale Hts., all of Ill.

[73] Assignee: Delaware Capital Fromation, Inc., Wilmington, Del.

[21] Appl. No.: 08/969,425

[22] Filed: Nov. 1, 1997

[51] Int. Cl.[7] ..... A47B 77/06

[52] U.S. Cl. ..... 126/349; 4/658; 108/25; 312/140.4

[58] Field of Search ..... 126/345, 373, 126/349; 4/286, 292, 658, 654, 656, 659; 222/166; 141/284; 99/407; 108/25, 26, 27; 312/140.1, 140.4

[56] References Cited

U.S. PATENT DOCUMENTS

| | | | |
|---|---|---|---|
| 1,221,137 | 4/1917 | Carney . | |
| 1,225,256 | 5/1917 | Lambrix . | |
| 2,210,250 | 8/1940 | Melville | 222/166 |
| 2,222,960 | 11/1940 | Strachan . | |
| 2,308,123 | 1/1943 | Stein . | |
| 2,314,157 | 3/1943 | O'Brien . | |
| 2,334,293 | 11/1943 | Stein . | |
| 2,815,888 | 12/1957 | Faucher | 126/349 |
| 3,211,344 | 10/1965 | Ekman et al. | 222/166 |
| 4,305,166 | 12/1981 | Rose . | |
| 5,070,554 | 12/1991 | Bertoli . | |
| 5,313,676 | 5/1994 | Wright . | |
| 5,621,929 | 4/1997 | Smith . | |

FOREIGN PATENT DOCUMENTS

| | | | |
|---|---|---|---|
| 32909 | 1/1908 | Austria | 126/349 |

*Primary Examiner*—Ira S. Lezarus
*Assistant Examiner*—Sara Clarke

[57] ABSTRACT

A work station has a cooking kettle mounted for movement between an upright cooking position and a tilted pouring position. The work station includes a support structure defining a work surface above which the cooking kettle is mounted. A splash guard is mounted on the support structure for movement between a first position whereat the splash guard forms a portion of the work surface and a second position whereat the splash guard forms a barrier against splashing substances poured from the kettle when in its pouring position.

25 Claims, 5 Drawing Sheets

COOKING WORK STATION WITH SPLASH GUARD

FIELD OF THE INVENTION

This invention generally relates to the art of cooking apparatus and, particularly, to a work station at which a cooking kettle is mounted and capable of tilting for pouring food substances therefrom.

BACKGROUND OF THE INVENTION

Large cooking kettles are used in food preparation establishments for preparing (heating) a wide variety of food substances. The kettles are too large to be manually manipulatable by an operator, so the kettles typically are mounted at a work station above a work surface for mechanical movement between an upright cooking position and a tilted pouring position. The large cooking kettles prepare viscous food substances, such as soup, stew or a variety of other food products which are poured from the kettle by tilting the kettle, when the food products are cooked. The large kettles also are used for cooking fluid mediums such as water in preparing pasta-type food products, and the water also is poured from the kettles. The kettles also are cleaned after use, and the washing water, itself, is poured from the kettles.

One of the problems inherent with the wide variety of pouring operations described above is the danger of the poured substances, which may be extremely hot, splashing onto an operator and causing severe burns, for instance. The viscous substances may be poured into containers at the work station, or cooking or cleaning water may be poured into containers at the work station for food draining or kettle cleaning purposes. Various approaches at providing safety guards for the operator have proven ineffective for a variety of reasons, including interference with normal manual functions of the operator and cluttering of the work station or work surface at which the functions are performed.

The present invention is directed to solving these problems by providing a unique splash guard at a work station, which does not interfere with an operator's work and actually forms a part of the work surface when not in use.

SUMMARY OF THE INVENTION

An object, therefore, of the invention is to provide a new and improved work station at which a cooking kettle is mounted for movement between an upright cooking position and a tilted pouring position.

Another object of the invention is to provide a new and improved splash guard system at such work stations.

In the exemplary embodiment of the invention, a support structure defines a work surface above which the cooking kettle is mounted. A splash guard is mounted on the support structure for movement between a first position whereat the splash guard forms a portion of the work surface, and a second position at an angle to the first position and whereat the splash guard forms a barrier against splashing substances poured from the kettle when in its pouring position.

As disclosed herein, the work surface is generally planar and the splash guard includes a generally planar plate portion which forms a continuation of the planar work surface when the splash guard is in its first position. The splash guard includes side flanges projecting from the plate portion toward the kettle when the splash guard is in its second position. Pivot means are provided for pivotally mounting the splash guard for movement between its first and second positions.

In the preferred embodiment, a sink is provided on the support structure in the work surface beneath the splash guard such that the splash guard covers the sink in its first position and exposes the sink in its second position. The pivot means is located to pivotally mount the splash guard adjacent a front wall of the sink away from the cooking kettle. As disclosed herein, the pivot means comprises a pivot shaft or other means projecting through or attached to opposite side walls of the sink which extend rearwardly of the front wall of the sink.

Various features are contemplated when using the pivot shaft as the pivot means. For instance, the pivot shaft may extend through slot means in the splash guard, with the slot means being open-ended to allow ready removal of the splash guard, such as for cleaning purposes. The slot means may be configured relative to the cross-sectional shape of the pivot shaft to allow removal of the splash guard only when in its first position. The slot means may be configured relative to the cross-sectional shape of the pivot shaft to allow removal of the splash guard only when the splash guard is moved in plural angular paths relative to the pivot shaft. Conversely, the pivot shaft could be secured to the splash guard, and the slot means could be formed in the support structure. Complementary interengaging latch means may be provided between the pivot shaft and the support structure to provide for ready removal of the pivot shaft and, therefore, removal of the splash guard.

Another feature of the invention contemplates a diffusion screen mounted adjacent the sink for movement between a first position whereat the screen is disposed in the bottom of the sink, and a second position at an angle to the first position and whereat the screen projects out of the sink. Common pivot means may be provided to pivotally mount the splash guard and the screen for movement between their respective first and second positions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
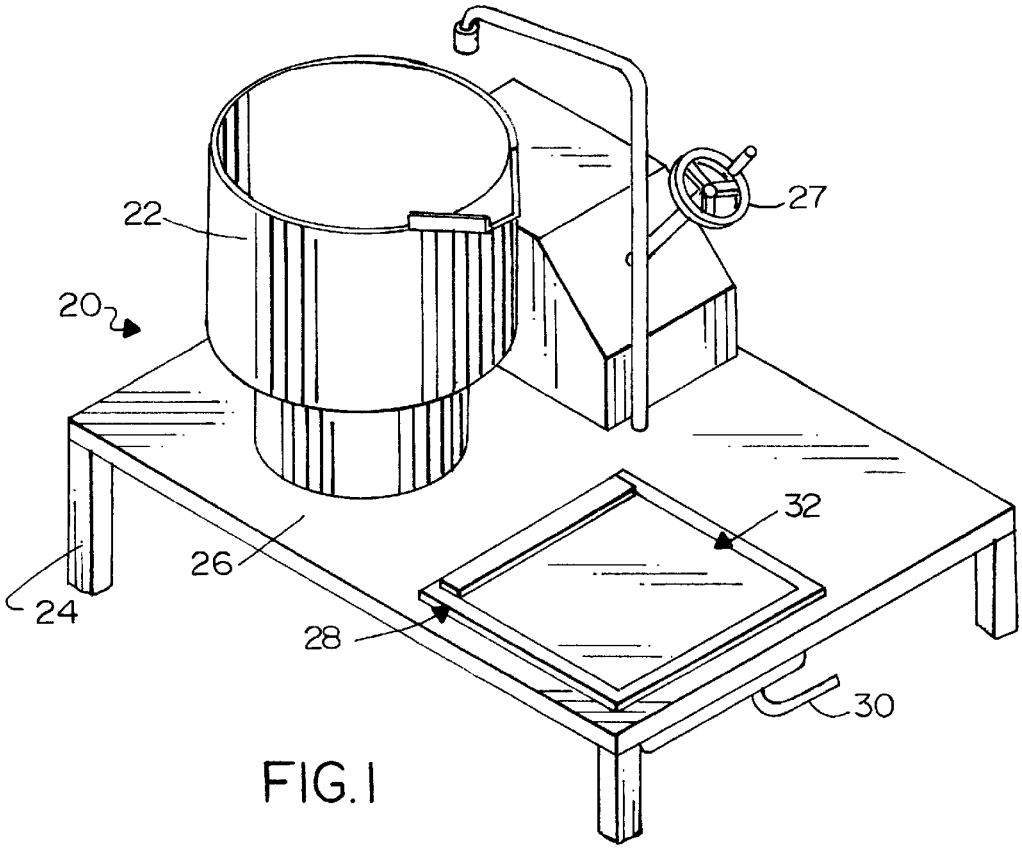
FIG. 1 is a perspective view of a work station with a cooking kettle in an upright position and the splash guard of the invention in its lowered position.
Figure 2:
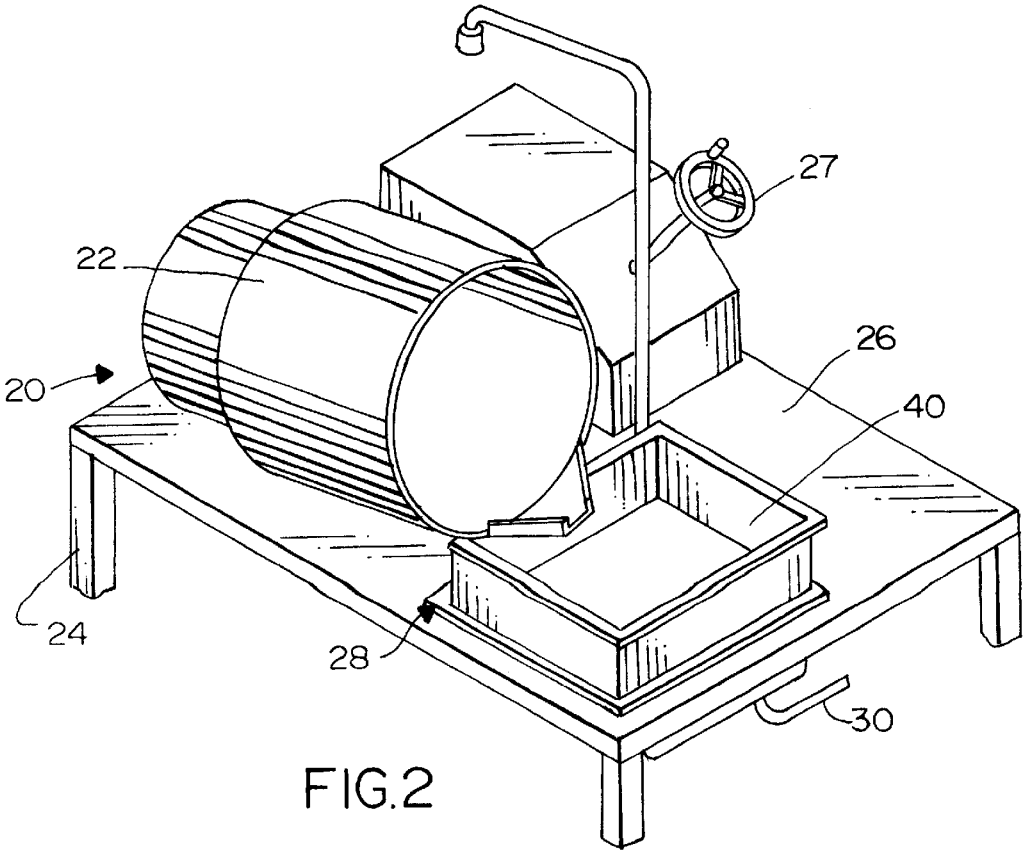
FIG. 2 is a perspective view similar to that of FIG. 1, with the kettle tilted for pouring, and a container is positioned on top of the splash guard.
Figure 3:
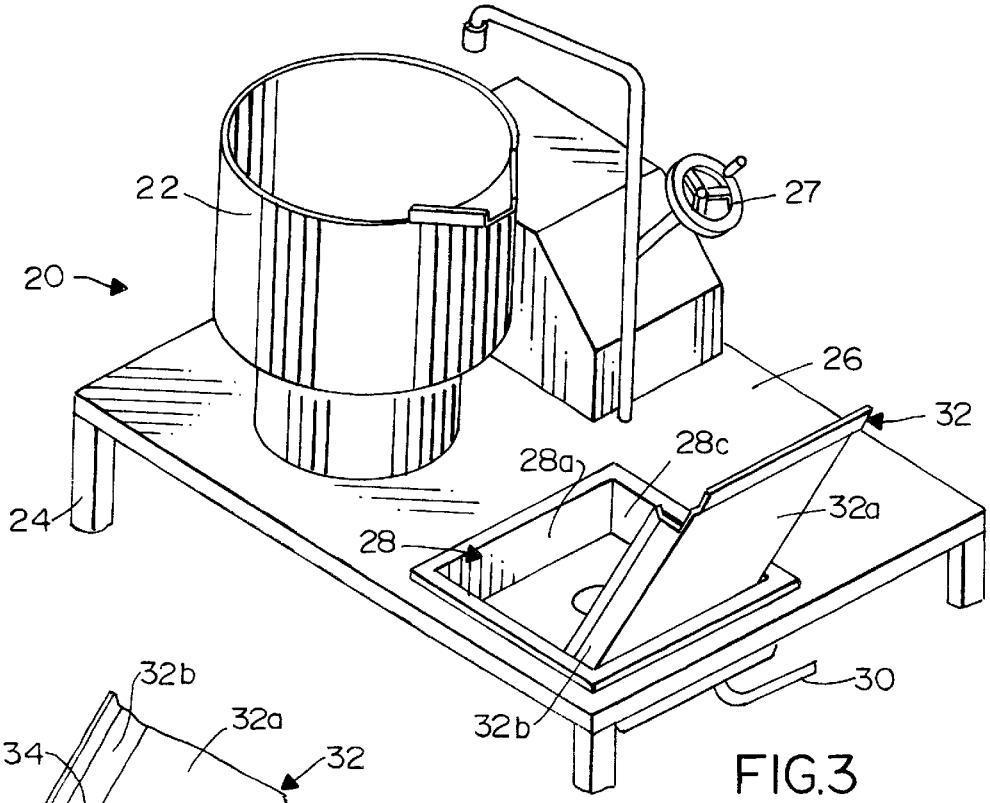
FIG. 3 is a perspective view similar to that of FIG. 1, but with the splash guard in its elevated position.
Figure 4:
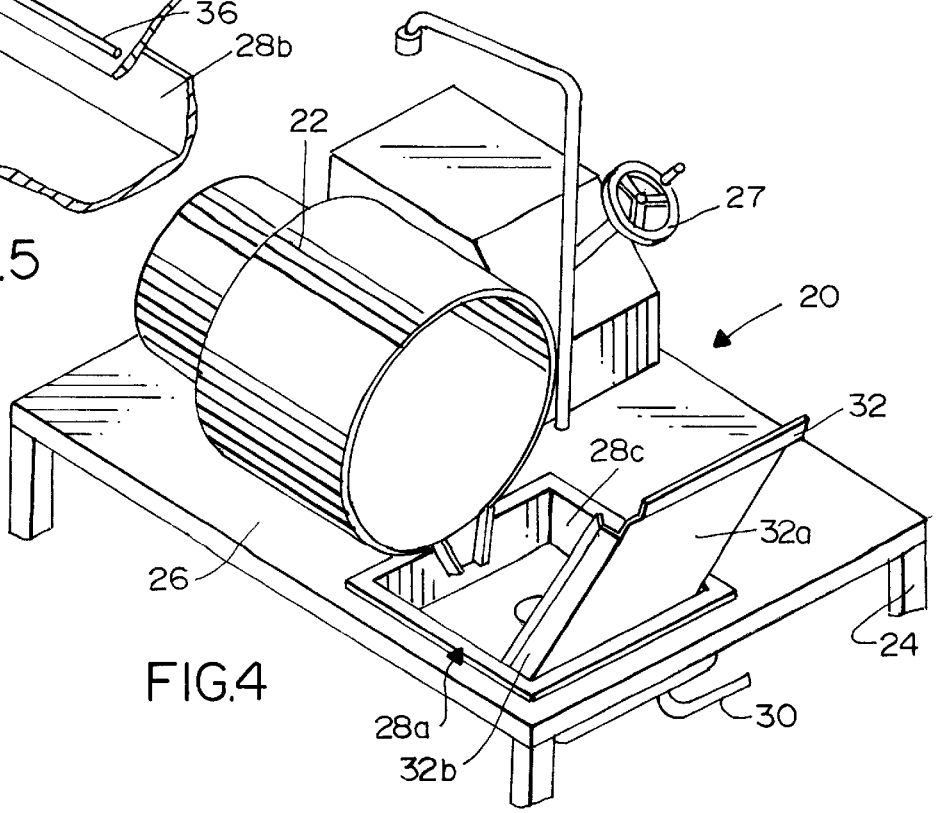
FIG. 4 is a view similar to that of FIG. 3, but with the kettle in its tilted position.

Referring to the drawings in greater detail, and first to FIG. 1, the invention is embodied in a work station, generally designated 20, at which a cooking kettle 22 is mounted for movement between an upright cooking position (FIGS. 1 and 3) and a tilted pouring position (FIGS. 2 and 4). The work station includes a support structure 24 defining a generally planar work surface 26 above which the cooking kettle is pivotally mounted for pivoting movement between its upright and tilted positions. The kettle may be a "jacketed" kettle which has an outer jacket and an inner kettle liner between which heating or cooling mediums are flowed for the preparation of food substances in the kettle.

The above description of work station 20, including cooking kettle 22, is generally typical of the prior art. A rotatable hand wheel 27 is provided to manually/mechanically tilt the kettle. In addition, a sink, generally designated 28 in a FIGS. 3 and 4, may be provided on support structure 24 in planar work surface 26. The sink can be used for positioning a relatively tall container (such as a bucket) therein for receiving contents poured from the kettle. More often, the sink is used for draining cooking fluid (pasta water) or cleaning water, and a drain 30 is provided for facilitating disposal of the fluid. The sink has a rear wall 28*a*, a front wall 28*b* (FIG. 5) and opposite side walls 28*c* (FIGS. 3 and 4).

The invention contemplates a splash guard, generally designated 32, mounted on support structure 24 at work surface 26 for movement between a first position (FIGS. 1 and 2) whereat the splash guard covers the sink and forms a portion of the work surface, and a second position (FIGS. 3 and 4) at an upward angle relative to the first position and whereat the splash guard forms a barrier against splashing substances poured from kettle 22.

Figure 5:
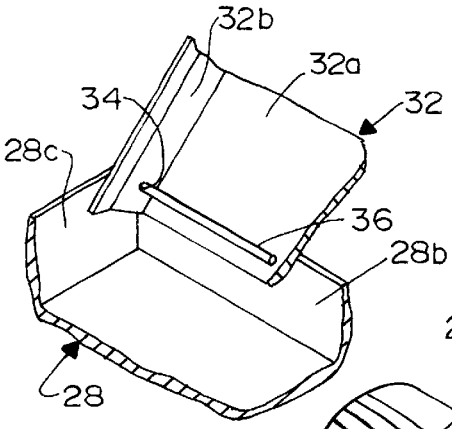
FIG. 5 is an enlarged perspective view of the area of the pivot shaft which mounts the splash guard.
Figure 6:
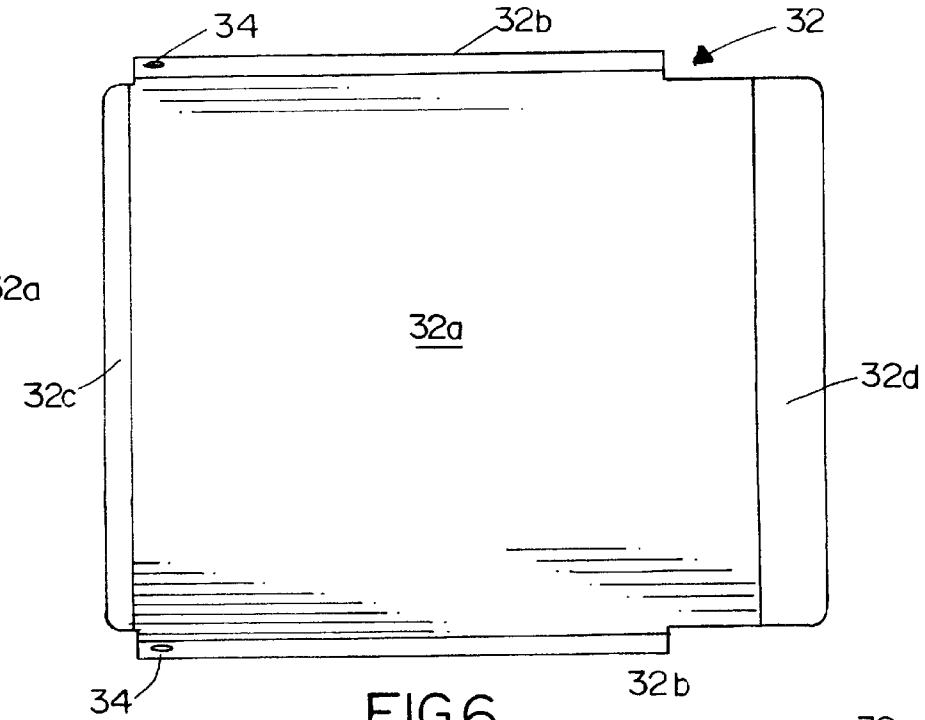
FIG. 6 is a plan view of the splash guard.
Figure 7:
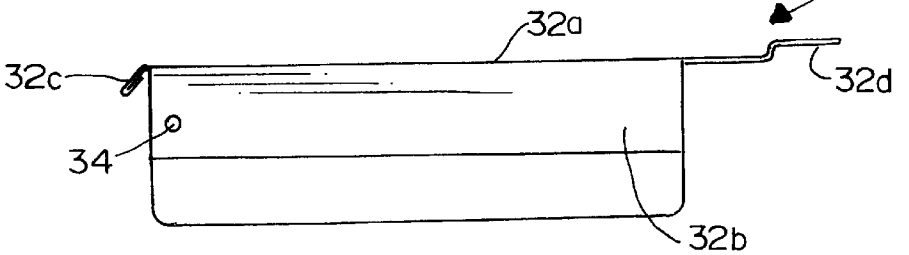
FIG. 7 is a side elevational view of the splash guard.
Figure 8:
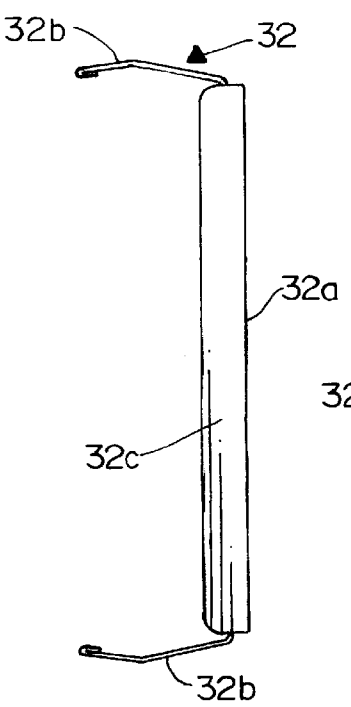
FIG. 8 is a rear elevational view of the splash guard.

Referring to FIGS. 6–8 in conjunction with FIGS. 1–5, splash guard 32 includes a generally planar plate portion 32*a* and a pair of side flanges 32*b* projecting from the plate portion toward kettle 22 when the splash guard is in its elevated position as seen in FIGS. 3 and 4. An angled deflection lip 32*c* extends across one edge of plate portion 32*a*, and an offset support lip 32*d* extends across an opposite edge of the plate portion. Finally, a pivot hole 34 is formed in each side flange 32*b* as seen in FIG. 7.

Splash guard 32 is pivotally mounted by means of a pivot shaft 36 seen best in FIG. 5. The pivot shaft extends through pivot holes 34 in side flanges 32*b* of the splash guard and through side walls 28*c* of the sink. The pivot shaft is effective for pivotally mounting the splash guard adjacent front wall 28*b* of the sink away from the cooking kettle, for pivotal movement of the splash guard between its lowered position (FIGS. 1 and 2) and its elevated position (FIGS. 3 and 4). In its lowered position, side flanges 32*b* of the splash guard are juxtaposed inside side walls 28*c* of the sink, and offset support lip 32*d* of the splash guard rests on top of the rear ledge of the sink adjacent rear wall 28*a* of the sink. In its lowered position as shown in FIG. 1, the splash guard actually forms a portion of work surface 26. With support lip 32*d* of the splash guard being offset, the planar plate portion 32*a* of the splash guard substantially forms a continuation of the planar work surface. In its lowered position, a container, such as a pan 40 shown in FIG. 2, can be positioned on top of the splash guard and substances from the kettle poured thereinto. In essence, in its lowered position, the splash guard does not interfere with normal work functions of an operator, and the splash guard does not in any way clutter the work surface or area at the work station.

In the elevated position of splash guard 32 as shown in FIGS. 3 and 4, the splash guard provides a protective barrier for an operator while substances are poured from kettle 22 either directly into sink 28 or into a container position in the sink. Side flanges 32*b* not only provide side barriers for the splash guard, but, depending upon the size of kettle 22 and the position of sink 28 and splash guard 32, the splash guard actually can function as a funnel to divert liquids poured from the kettle into the sink.

Figure 9:
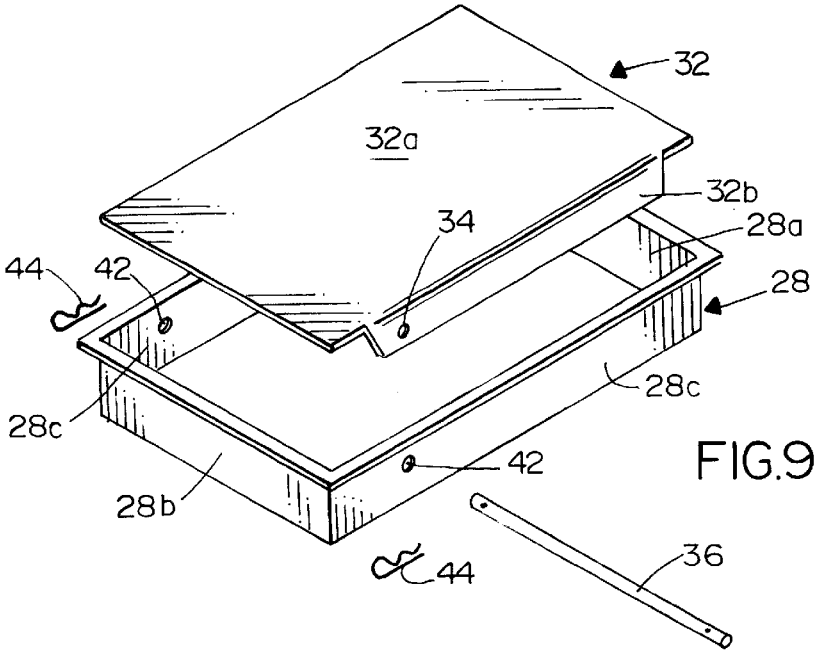
FIG. 9 is a somewhat schematic view of the pivot arrangement between the splash guard and the sink.

FIG. 9 shows one of several arrangements for mounting pivot shaft 36. As stated above, the pivot shaft extends through pivot holes 34 in side flanges 32*b* of the splash guard and through side walls 28*c* of the sink. Appropriate holes 42 may be provided in the side walls for passing the pivot shaft therethrough. A pair of spring clips 44 are removably fixed to opposite ends of pivot shaft 36, outside side walls 28*c* of the sink, to hold the pivot shaft, splash guard and sink in assembly. The spring clips are readily removable beneath the work surface to remove the pivot shaft and, thereby, the splash guard for cleaning, repair or replacement purposes.

Figure 10:
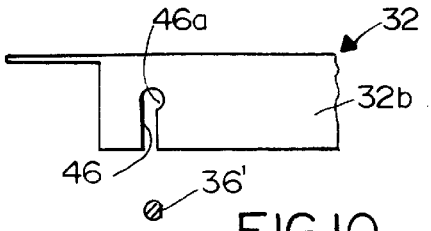
FIG. 10 is a fragmented, somewhat schematic view of one embodiment of a slotted arrangement for mounting the splash guard on the pivot shaft.

FIG. 10 shows a slotted arrangement whereby the splash guard can be removed from the pivot shaft in only one position of the splash guard. More particularly, the splash guard has an open-ended slot 46 in each side flange 32*b*, with the slot having an enlarged closed end 46*a*. Pivot shaft 36' is D-shaped in cross-section as seen in FIG. 10. With this arrangement, the splash guard can be removed only when in its lowered or horizontal position as shown in FIGS. 1 and 2. More particularly, slot 46 is wide enough for only the narrow dimension of D-shaped shaft 36' to pass therethrough. When the splash guard is elevated, the shaft is captured within enlarged closed end 46*a* of the slot and the large dimension of the D-shaped shaft cannot move into the slot. This prevents undesirable lost motion between the splash guard and the shaft. In addition, the splash guard cannot be moved away from the shaft because of the close proximity of the splash guard to the front wall of the sink.

Figure 11:
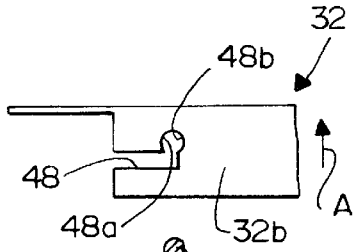
FIG. 11 is a view similar to that of FIG. 10, but of another embodiment of a slotted arrangement.

FIG. 11 shows another slotted arrangement whereby the splash guard can be removed only when moved in plural angular paths relative to D-shaped pivot shaft 36'. More particularly, each side flange 32*b* of the splash guard has an open-ended slot 48 which leads to a perpendicular slot portion 48*a* which, in turn, leads to an enlarged closed end 48*b* of the slot. With this arrangement, the splash guard first must be lifted in the direction of arrow "A" whereupon the narrow dimension of the D-shaped shaft 36' moves along slot portion 48*a* into open-ended slot 48. However, the shaft cannot move into open-ended slot 48 because the slot is narrower than the large dimension of the D-shaped shaft. Therefore, the splash guard must be rotated 90° so that the shaft can move through and out of slot 48*a*.

Figure 12A:
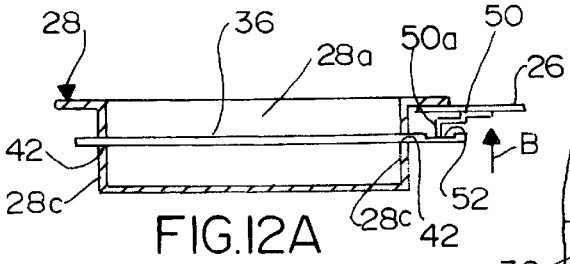
FIGS. 12A–12C show various embodiments of a spring latch for removably latching the pivot shaft.
Figure 12B:
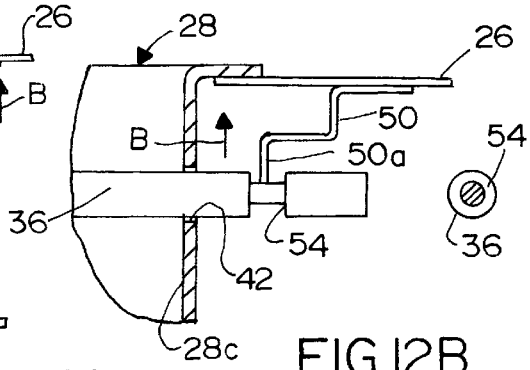
Figure 12C:
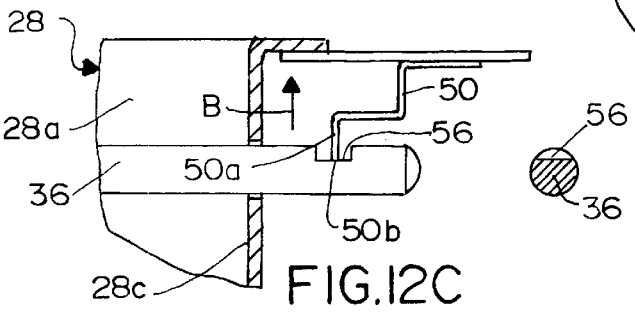

FIGS. 12A–12C show a spring latch 50 mounted beneath work surface 26 for removably mounting pivot shaft 36 between side walls 28*c* of sink 28. More particularly, spring latch 50 has a latching lip 50*a* which projects into a recess 52 in one end of pivot shaft 36. The spring latch is resiliently movable in the direction of arrow "B" to lift latching lip 50*a* out of recess 52 so that pivot shaft 36 is free to move axially for ready removal thereof and, thereby, removal of the splash guard.

FIG. 12B shows an arrangement similar to FIG. 12A wherein spring clip 50, including latching lip 50*a,* is used to releasably hold pivot shaft 36 in assembly. In this arrangement, the pivot shaft is recessed, as at 54, entirely about the circumference thereof. Again, the spring latch is moved in the direction of arrow "B" to lift latching lip 50*a* out of recess 54 to allow removal of the pivot shaft. This arrangement would be most applicable for use with a splash guard simply having pivot holes 34.

In the arrangement of FIG. 12C, pivot shaft 36 is provided with a recess 56 which is substantially flat for receiving a flat edge 50*b* of latching lip 50*a* of spring latch 50. This prevents rotation of the pivot shaft, and this arrangement would be most applicable with a splash guard having slot means such as shown in FIGS. 10 or 11.

Figure 13A:
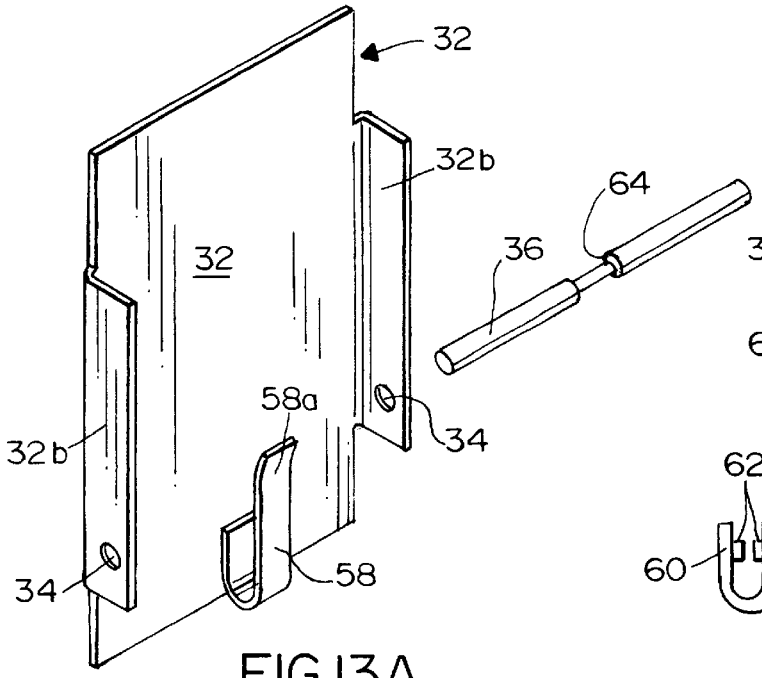
FIGS. 13A–13C show an arrangement of a leaf spring on the splash guard for mounting the splash guard on the pivot shaft.
Figure 13B:
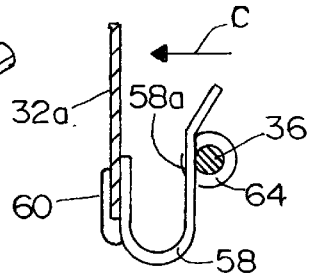
Figure 13C:
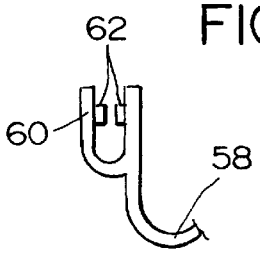

FIGS. 13A–13C show an arrangement for readily disassembling and removing splash guard 32 and pivot shaft 36 by means of a generally U-shaped leaf spring 58. One leg of the leaf spring is bifurcated, as at 60 in FIG. 13C, and includes detents 62 for mounting the leaf spring in appropriate holes in plate portion 32*a* of the splash guard. The leg need not be bifurcated, and can be attached to the splash guard by a variety of means such as welds, screws, bolts or the like. A free leg 58*a* of the leaf spring is biased into a centrally located recess 64 formed in pivot shaft 36 to hold the pivot shaft in position through side flanges 32*b* of the splash guard and the side walls of the sink. Free leg 58 of the leaf spring is moved in the direction of arrow "C" (FIG. 13B) to move the leg out of recess 64 in pivot shaft 36 to allow for axial removal of the pivot shaft and, thereby, removal of the splash guard for cleaning, repair or replacement purposes.

Figure 14B:
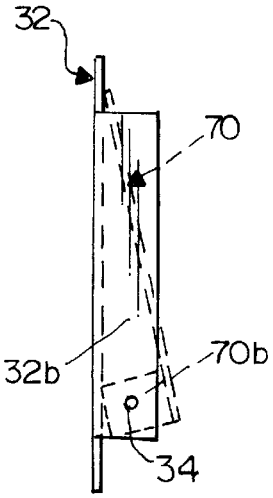
FIGS. 14A and 14B show an arrangement which includes a diffusion screen.
Figure 14A:
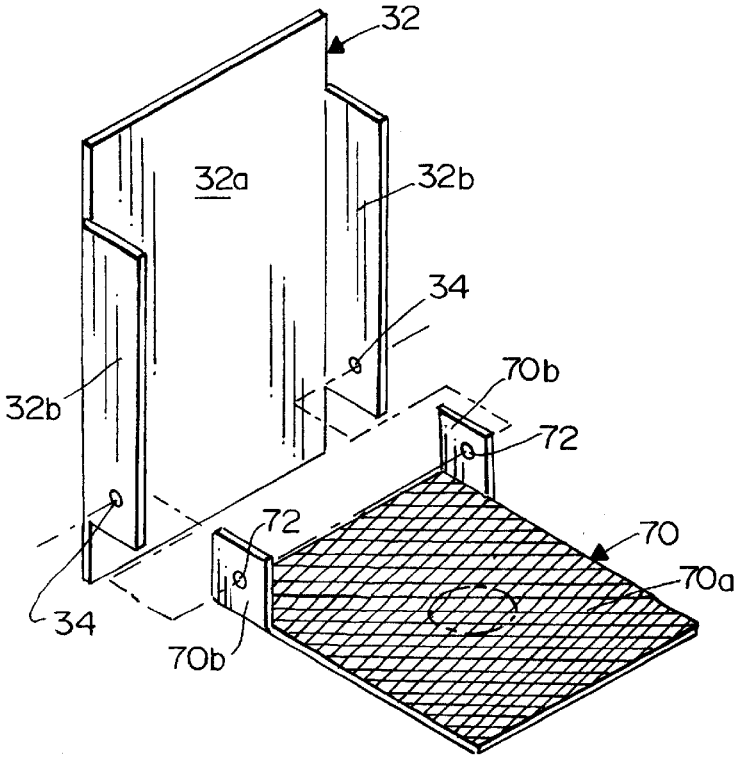

Lastly, FIGS. 14A and 14B show a feature of the invention wherein a diffusion screen or mesh, generally designated 70, is pivotally mounted on the same pivot shaft which mounts splash guard 32. In other words, the screen is pivotally mounted for movement between a first position (FIG. 14A) whereat the screen is disposed in the bottom the sink, and a second position (FIG. 14B) whereat the screen projects out of the sink and is disposed inside splash guard 32. The screen has a generally planar portion 70*a* and a pair of mounting ears 70*b* which have holes 72 through which pivot shaft 36 extends. In its lowered position as shown in FIG. 14A, the screen diffuses liquid poured from the kettle into the sink to further provide anti-splash protection. In its elevated position as shown in FIG. 14B, the screen functions to diffuse liquids poured from the kettle against the splash guard. The screen can have its own, independent pivot means, other than the common pivot of shaft 36 for the splash guard.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A work station at which a cooking kettle is mounted for movement between an upright cooking position and a tilted pouring position, comprising:

a support structure defining a work surface above which the cooking kettle is mounted; and a splash guard mounted on the support structure for movement between a generally horizontal first position whereat the splash guard forms a portion of the work surface and a second generally upright position whereat the splash guard forms a barrier against splashing substances poured from the kettle when in its pouring position.

2. A work station at which a cooking kettle is mounted for movement between an upright cooking position and a tilted pouring position, comprising:

a support structure on which the cooking kettle is mounted; and a splash guard mounted adjacent the support structure for movement between a generally horizontal first position whereat the splash guard forms a work surface and a generally upright position whereat the splash guard forms a barrier against splashing substances poured from the kettle when in its pouring position.

3. A work station at which a cooking kettle is mounted for movement between an upright cooking position and a tilted pouring position, comprising:

a generally planar support structure defining a work surface above which the cooking kettle is mounted; and a splash guard mounted on the support structure for movement between a first position whereat a generally planar plate portion of the splash guard forms a continuation of the planar work surface and a second position whereat the splash guard forms a barrier against splashing substances poured from the kettle when in its pouring position.

4. The work station of claim 3 wherein said splash guard includes side flanges projecting from the plate portion toward the kettle when the splash guard is in said second position.

5. A work station at which a cooking kettle is mounted for movement between an upright cooking position and a tilted pouring position, comprising:

a support structure defining a work surface above which the cooking kettle is mounted;

a splash guard mounted on the support structure for movement between a first position whereat the splash guard forms a portion of the work surface and a second position whereat the splash guard forms a barrier against splashing substances poured from the kettle when in its pouring position; and pivot means pivotally mounting the splash guard for movement between said first and second positions.

6. A work station at which a cooking kettle is mounted for movement between an upright cooking position and a tilted pouring position, comprising:

a support structure defining a work surface above which the cooking kettle is mounted;

a splash guard mounted on the support structure for movement between a first position whereat the splash guard forms a portion of the work surface and a second position whereat the splash guard forms a barrier against splashing substances poured from the kettle when in its pouring position; and a sink on the support structure in the work surface beneath the splash guard such that the splash guard covers the sink in said first position and exposes the sink in said second position.

7. The work station of claim 6, including pivot means pivotally mounting the splash guard for movement between said first and second positions.

8. The work station of claim 7 wherein said pivot means is located to pivotally mount the splash guard adjacent a front wall of the sink away from the cooking kettle.

9. The work station of claim 8 wherein said pivot means comprises a pivot shaft operatively associated with opposite side walls of the sink which extend rearwardly of said front wall.

10. The work station of claim 9 wherein said pivot shaft extends through slot means in the splash guard, the slot means being open-ended to allow ready removal of the splash guard.

11. The work station of claim 10 wherein said slot means is configured relative to the cross-sectional shape of the pivot shaft to allow removal of the splash guard only when in said first position.

12. The work station of claim 10 wherein said slot means is configured relative to the cross-sectional shape of the pivot shaft to allow removal of the splash guard only when the splash guard is moved in plural angular paths relative to the pivot shaft.

13. The work station of claim 9, including complementary interengaging latch means between the pivot shaft and the support structure to provide for ready removal of the pivot shaft and, therefor, removal of the splash guard.

14. The work station of claim 6, including a diffusion screen mounted adjacent the sink for movement between a first position whereat the screen is disposed in the bottom of the sink and a second position at an angle to the first position and whereat the screen projects out of the sink.

15. The work station of claim 14, including common pivot means pivotally mounting the splash guard and the screen for movement between their respective first and second positions.

16. A work station at which a cooking kettle is mounted for movement between an upright cooking position and a tilted pouring position, comprising:

a support structure defining a generally planar work surface above which the cooking kettle is mounted, and a sink on the support structure in the work surface adjacent the kettle; and a splash guard mounted on the support structure generally at the top of the sink by pivot means providing for pivotal movement of the splash guard between a first position whereat the splash guard forms a portion of the work surface and a second position at an angle to the first position and whereat the splash guard forms a barrier against splashing substances poured from the kettle when in its pouring position, the splash guard including a generally planar plate portion which covers the sink and forms a continuation of the planar work surface when the splash guard in said first position and exposes the sink when the splash guard is in said second position.

17. The work station of claim 16 wherein said splash guard includes side flanges projecting from the plate portion toward the kettle when the splash guard is in said second position.

18. The work station of claim 16 wherein said pivot means is located to pivotally mount the splash guard adjacent a front wall of the sink away from the cooking kettle.

19. The work station of claim 18 wherein said pivot means comprises a pivot shaft projecting through opposite side walls of the sink which extend rearwardly of said front wall.

20. The work station of claim 19 wherein said pivot shaft extends through slot means in the splash guard, the slot means being open-ended to allow ready removal of the splash guard.

21. The work station of claim 20 wherein said slot means is configured relative to the cross-sectional shape of the pivot shaft to allow removal of the splash guard only when in said first position.

22. The work station of claim 20 wherein said slot means is configured relative to the cross-sectional shape of the pivot shaft to allow removal of the splash guard only when the splash guard is moved in plural angular paths relative to the pivot shaft.

23. The work station of claim 19, including complementary interengaging latch means between the pivot shaft and the support structure to provide for ready removal of the pivot shaft and, therefor, removal of the splash guard.

24. The work station of claim 16, including a diffusion screen mounted adjacent the sink for movement between a first position whereat the screen is disposed in the bottom of the sink and a second position at an angle to the first position and whereat the screen projects out of the sink.

25. The work station of claim 24, including common pivot means pivotally mounting the splash guard and the screen for movement between their respective first and second positions.

* * * * *